US010331152B2

(12) United States Patent
Jefremow et al.

(10) Patent No.: US 10,331,152 B2
(45) Date of Patent: Jun. 25, 2019

(54) QUIESCENT CURRENT CONTROL IN VOLTAGE REGULATORS

(71) Applicant: Dialog Semiconductor (UK) Limited, London (GB)

(72) Inventors: Mihail Jefremow, Augsburg (DE); Dan Ciomaga, Ingolstadt (DE); Gennadii Tatarchenkov, Germering (DE); Stephan Drebinger, Munich (DE); Fabio Rigoni, Karlsfeld (DE)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 15/946,793

(22) Filed: Apr. 6, 2018

(65) Prior Publication Data

US 2018/0292853 A1 Oct. 11, 2018

(30) Foreign Application Priority Data

Apr. 7, 2017 (DE) ..... 10 2017 205 957

(51) Int. Cl.
*G05F 1/575* (2006.01)
*G05F 1/565* (2006.01)
*G05F 1/10* (2006.01)

(52) U.S. Cl.
CPC ..... *G05F 1/575* (2013.01); *G05F 1/565* (2013.01); *G05F 1/10* (2013.01)

(58) Field of Classification Search
CPC ... G05F 1/10; G05F 1/46; G05F 1/461; G05F 1/465; G05F 1/56; G05F 1/565;
(Continued)

(56) References Cited

U.S. PATENT DOCUMENTS 8,816,658 B1 * 8/2014 De Vita ..... G05F 1/575 323/275
9,256,237 B2 * 2/2016 Kim ..... G05F 1/575
(Continued)

FOREIGN PATENT DOCUMENTS

DE 10 2015 216 493 3/2017
DE 10 2016 200 390 7/2017

OTHER PUBLICATIONS

German Office Action, File No. 10 2017 205 957.5, Applicant: Dialog Semiconductor (UK) Limited, dated Nov. 28, 2017, 12 pages and English language translation, 9 pages.

*Primary Examiner* — Gustavo A Rosario-Benitez
(74) *Attorney, Agent, or Firm* — Saile Ackerman LLC; Stephen B. Ackerman

(57) ABSTRACT

A circuit for generating an output voltage, and regulating the output voltage to a target voltage, is described. The circuit comprises a pass device coupled between an input voltage level and an output voltage level, an error amplifier stage configured to generate a first control voltage on the basis of a reference voltage and the output voltage, a buffer stage configured to generate a drive signal for the pass device on the basis of the first control voltage, and a tracking circuit configured to track a voltage across the pass device and to generate a second control voltage on the basis of the voltage across the pass device. The buffer stage comprises a variable resistance element, for limiting a current flowing through the buffer stage on the basis of the second control voltage.

8 Claims, 7 Drawing Sheets

(58) Field of Classification Search
CPC ... G05F 1/575; G05F 3/02; G05F 3/08; G05F 3/16; G05F 3/24; G05F 3/242; G05F 3/30
See application file for complete search history.

(56) References Cited

U.S. PATENT DOCUMENTS

| | | | | |
|---|---|---|---|---|
| 2004/0140845 | A1 | 7/2004 | Eberlein | |
| 2006/0164053 | A1 | 7/2006 | Walter et al. | |
| 2012/0223688 | A1 | 9/2012 | Iriarte et al. | |
| 2013/0147447 | A1* | 6/2013 | Liu | G05F 1/575 323/273 |
| 2013/0307502 | A1* | 11/2013 | Bhattacharyya | G05F 1/565 323/282 |
| 2014/0210430 | A1* | 7/2014 | Bhattad | G05F 3/02 323/233 |
| 2014/0247087 | A1 | 9/2014 | Bhattad et al. | |
| 2014/0266106 | A1* | 9/2014 | El-Nozahi | G05F 1/575 323/280 |
| 2017/0063217 | A1* | 3/2017 | Shin | G05F 1/575 |
| 2017/0090494 | A1* | 3/2017 | Cui | G05F 1/562 |

* cited by examiner

QUIESCENT CURRENT CONTROL IN VOLTAGE REGULATORS

TECHNICAL FIELD

This application relates to circuits and methods for generating an output voltage and regulating the output voltage to a target voltage, in particular to such circuits and methods that allow for reducing power consumption, e.g., power consumption resulting from a quiescent current flowing in the buffer stage of low-dropout regulators (LDOs).

BACKGROUND

Almost every modern power management integrated circuit (IC) incorporates a variety of different LDOs to provide stable and accurately regulated voltage supplies. The LDO drops the input voltage $V_{in}$ by the pass device to the output voltage $V_{out}$ to provide a regulated supply that is free of any noise. With steadily increasing demand for more regulated voltage supplies (e.g., a modern power management IC (PMIC) can include more than 20 LDOs), the current consumption ($I_q$) of the LDOs becomes the key parameter for power efficiency.

A class of LDOs may be very efficient in normal operation mode where the output voltage $V_{out}$ is well below the input voltage $V_{in}$, the quiescent current $I_q$ at low load condition is well controlled to a low value (e.g., <20 μA), and the current efficiency is very good. However, in a scenario where the input voltage $V_{in}$ of the LDO is close to the desired regulated output voltage, i.e., in the so-called dropout operation region, the quiescent current $I_q$ of the LDO increases (e.g., up to several mA) and is independent of the load current. This behavior heavily disrupts the power efficiency of the LDO.

SUMMARY

There is a need for improved quiescent current control in voltage regulators, specifically for a circuit for generating an output voltage and regulating the output voltage to a target voltage, and for an improved method of generating the output voltage and regulating the output voltage to a target voltage (or an improved method of controlling a circuit for generating the output voltage and regulating the output voltage to a target voltage). There further is a need for such a circuit and method to reduce power consumption, and to reduce a quiescent current flowing through a buffer stage of a low-dropout regulator (LDO). In particular, there is a need for such a circuit and method to guarantee substantially constant quiescent current $I_q$ of the LDO, across the entire operation range for the input voltage, and to reduce the quiescent current $I_q$ in the deep dropout case.

In view of some or all of these needs, the present disclosure proposes a circuit for generating an output voltage and regulating the output voltage to a target voltage and a method of operating a circuit for generating an output voltage and regulating the output voltage to a target voltage, having the features of the respective independent claims.

An aspect of the disclosure relates to a circuit (e.g., an LDO) for generating an output voltage and regulating the output voltage to a target voltage. The circuit may include a pass device (e.g., output pass device) coupled (e.g., connected) between an input voltage level and an output voltage level (e.g., between the input voltage level and the output node of the circuit). The pass device may be a pass transistor (e.g., output transistor). The circuit may further include an error amplifier stage configured to generate a first control voltage on the basis of (e.g., depending on) a reference voltage and the output voltage. The error amplifier stage may comprise an error amplifier. The first control voltage may be generated on the basis of (e.g., depending on) a fixed fraction of the output voltage. The circuit may further include a buffer stage configured to generate a drive signal for the pass device on the basis of (e.g., depending on) the first control voltage. The circuit may yet further include a tracking circuit (e.g., VDS tracking circuit) configured to track a voltage across the pass device and to generate a second control voltage on the basis of (e.g., depending on) the voltage across the pass device. The buffer stage may include a variable resistance element for limiting a current flowing through the buffer stage on the basis of (e.g., depending on) the second control voltage. Therein, a resistance value of the variable resistance element may depend on the second control voltage. The current may be a current flowing to ground from a supply voltage level. The pass device and all other transistors mentioned throughout this disclosure may be MOS transistors, e.g. MOSFETs.

Thus, the circuit comprises a current mode buffer stage and a (VDS) tracking circuit, and applies a so-called starved current mode buffer approach. Configured as such, the circuit guarantees almost constant quiescent current $I_q$ (proportional to the load current) of the LDO across the entire input voltage operation range and reduces the quiescent current $I_q$ in the deep dropout case. In particular, the quiescent current $I_q$ is independent of the input voltage $V_{in}$, the quiescent current Iq is proportional to the load current, which ensures best power efficiency, and the quiescent current $I_q$ is fixed for deep dropout operation (the fixed value may or may not depend on the load current).

The proposed circuit may achieve the above advantages by adding only two additional transistors, one as acting as the variable resistance element, the other one being included in the tracking circuit, to realize the desired performance for a PMOS LDO structure. Further, the proposed solution is extendable to any LDO structure like a NMOS LDO or more complex LDO structures.

In embodiments, the buffer stage further includes a circuit branch comprising a first transistor and a second transistor coupled (e.g., connected) in series (not necessarily in this order) with the variable resistance element. The circuit branch (i.e., a series connection of the first transistor, the second transistor and the variable resistance element, not necessarily in this order) may be coupled (e.g., connected) between a supply voltage level and ground. The variable resistance element may limit a current flowing through the circuit branch. The first transistor may form a current mirror with the pass device. Further, a first voltage depending on the first control voltage may be supplied (e.g., fed, or provided) to a gate terminal of the second transistor.

Thereby, a particularly simple and efficient structure for implementing the buffer stage and for limiting the current flowing through the buffer stage can be provided.

In embodiments, the tracking circuit may include a third transistor and a current source that may be coupled (e.g., connected) in series (not necessarily in this order) between a drain terminal of the pass device and a predetermined voltage level. The third transistor may be referred to as a tracking transistor. The third transistor may be of the same type as the pass device. For a PMOS pass device, the predetermined voltage level may be ground. For an NMOS pass device, the predetermined voltage level may be a supply voltage level (e.g., Vdd). The current source may generate a bias current. A gate terminal and a drain terminal of the third transistor may be coupled (e.g., connected) to each other. Further, the second control voltage may be the voltage at the gate terminal of the third transistor.

Thereby, a particularly simple and efficient structure for tracking the voltage across the pass device and for controlling the variable resistance element via the second control voltage can be provided.

In embodiments, the variable resistance element may be a fourth transistor. Further, the second control voltage may be supplied to a gate terminal of the fourth transistor. For example, control terminals of the third and fourth transistors may be coupled (e.g., connected) to each other.

Thereby, the variable resistance element can be implemented in a simple manner, and efficient control of the variable resistance element is enabled.

In embodiments, the pass device, the first transistor, the third transistor, and the fourth transistor may be PMOS transistors and the second transistor may be an NMOS transistor. Further, the first, second, and fourth transistors may be coupled (e.g., connected) in series (not necessarily in this order) between a supply voltage level (e.g., the input voltage level) and ground. Yet further, the third transistor and the current source may be coupled (e.g., connected) in series (not necessarily in this order) between the drain terminal of the pass device and ground. Accordingly, the proposed solution can be readily applied to a PMOS LDO structure.

In embodiments, the fourth transistor may be coupled (e.g., connected) between a source terminal of the first transistor and the input voltage level. Further, gate and drain terminals of the first transistor may be coupled (e.g., connected) to each other.

In embodiments, the pass device, the first transistor, the third transistor, and the fourth transistor may be NMOS transistors and the second transistor may be a PMOS transistor. Further, the first, second, and fourth transistors may be coupled (e.g., connected) in series (not necessarily in this order) between a supply voltage level (e.g., Vdd) and ground (e.g., between said supply voltage level and the output voltage level). Yet further, the third transistor and the current source may be coupled (e.g., connected) in series (not necessarily in this order) between the drain terminal of the pass device and the supply voltage level. Accordingly, the proposed solution can be readily applied to a NMOS LDO structure.

In embodiments, the fourth transistor may be coupled (e.g., connected) between a source terminal of the first transistor and ground (e.g., between said source terminal and the output voltage level). Further, gate and drain terminals of the first transistor may be coupled (e.g., connected) to each other.

In embodiments, the buffer stage may further include a second circuit branch comprising a fifth transistor, a sixth transistor, and a seventh transistor coupled (e.g., connected) in series (not necessarily in this order). For example, the second circuit branch may be coupled (e.g., connected) between the supply voltage level and ground. The circuit may further include a second tracking circuit (e.g., VDS tracking circuit) for tracking a voltage across the second transistor and for generating a third control voltage on the basis of (e.g., depending on) the voltage across the second transistor. The fifth transistor may be a PMOS transistor and form a current mirror with the second transistor. The sixth transistor may be an NMOS transistor and a second voltage depending on the first control voltage (e.g., the first control voltage itself) may be supplied to a gate terminal of the sixth transistor. The seventh transistor may be a PMOS transistor and the third control voltage may be supplied to a gate terminal of the seventh transistor.

Another aspect of the disclosure relates to a method of operating a circuit for generating an output voltage and regulating the output voltage to a target voltage. The circuit may include a pass device (e.g., output pass device) coupled (e.g., connected) between an input voltage level and an output voltage level (e.g., an output node of the circuit). The pass device may be a pass transistor (e.g., output transistor). The method may include generating a first control voltage on the basis of (e.g., depending on) a reference voltage and the output voltage by means of an error amplifier stage (e.g., error amplifier). The first control voltage may be generated on the basis of (e.g., depending on) a fixed fraction of the output voltage. The method may further include generating a drive signal for the pass device on the basis of (e.g., depending on) the first control voltage by means of a buffer stage. The method may further include tracking a voltage across the pass device and generating a second control voltage on the basis of (e.g., depending on) the voltage across the pass device by means of a tracking circuit (e.g., VDS tracking circuit). The method may yet further include limiting a current flowing through the buffer stage on the basis of (e.g., depending on) the second control voltage by means of a variable resistance element included in the buffer stage. A resistance value of the variable resistance element may depend on the second control voltage. The current may be a current flowing to ground from a supply voltage level. The pass device and all other transistors mentioned throughout this disclosure may be MOS transistors, e.g. MOSFETs.

In embodiments, the buffer stage may further include a circuit branch comprising a first transistor and a second transistor coupled (e.g., connected) in series (not necessarily in this order) with the variable resistance element. The circuit branch (i.e., a series connection of the first transistor, the second transistor and the variable resistance element, not necessarily in this order) may be coupled (e.g., connected) between a supply voltage level and ground. The method may include limiting a current flowing through the circuit branch by means of the variable resistance element. The first transistor may form a current mirror with the pass device. The method may further include supplying a first voltage depending on the first control voltage to a gate terminal of the second transistor.

In embodiments, the tracking circuit may include a third transistor and a current source that may be coupled (e.g., connected) in series (not necessarily in this order) between a drain terminal of the pass device and a predetermined voltage level. The third transistor may be referred to as a tracking transistor. The third transistor may be of the same type as the pass device. For a PMOS pass device, the predetermined voltage level may be ground. For an NMOS pass device, the predetermined voltage level may a supply voltage level (e.g., Vdd). The method my include generating a bias current by means of the current source. A gate terminal and a drain terminal of the third transistor may be coupled (e.g., connected) to each other. The second control voltage may be the voltage at the gate terminal of the third transistor.

In embodiments, the variable resistance element may be a fourth transistor. The method may further include supplying the second control voltage to a gate terminal of the fourth transistor. For example, control terminals of the third and fourth transistors may be coupled (e.g., connected) to each other.

In embodiments, the pass device, the first transistor, the third transistor, and the fourth transistor may be PMOS transistors and the second transistor may be an NMOS transistor. The first, second, and fourth transistors may be coupled (e.g., connected) in series (not necessarily in this order) between a supply voltage level (e.g., the input voltage level for a PMOS pass device) and ground. Further, the third transistor and the current source may be coupled (e.g., connected) in series (not necessarily in this order) between the drain terminal of the pass device and ground.

In embodiments, the fourth transistor may be coupled (e.g., connected) between a source terminal of the first transistor and the input voltage level. Further, gate and drain terminals of the first transistor may be coupled (e.g., connected) to each other.

In embodiments, the pass device, the first transistor, the third transistor, and the fourth transistor may be NMOS transistors and the second transistor may be a PMOS transistor. The first, second, and fourth transistors may be coupled (e.g., connected) in series (not necessarily in this order) between a supply voltage level (e.g., Vdd) and ground (e.g., between said supply voltage level and the output voltage level). Further, the third transistor and the current source may be coupled (e.g., connected) in series (not necessarily in this order) between the drain terminal of the pass device and the supply voltage level.

In embodiments, the fourth transistor may be coupled (e.g., connected) between a source terminal of the first transistor and ground (e.g., between said source terminal and the output voltage level). Further, gate and drain terminals of the first transistor may be coupled (e.g., connected) to each other.

In embodiments, the buffer stage may further include a second circuit branch comprising a fifth transistor, a sixth transistor, and a seventh transistor coupled (e.g., connected) in series (not necessarily in this order). For example, the second circuit branch may be coupled (e.g., connected) between the supply voltage level and ground. The fifth transistor may be a PMOS transistor and form a current mirror with the second transistor. The sixth transistor may be an NMOS transistor and the seventh transistor may be a PMOS transistor. Then, the method may further include tracking a voltage across the second transistor and generating a third control voltage on the basis of the voltage across the second transistor by means of a second tracking circuit. The method may further include supplying a second voltage depending on the first control voltage to a gate terminal of the sixth transistor. The method may yet further include supplying the third control voltage to a gate terminal of the seventh transistor.

Notably, the method may be applied to any of the circuits described above, for example as a method of operating these circuits. In addition to steps for operating these circuits, the method may further include steps for providing or arranging some or all of the elements of these circuits and/or steps for coupling or connecting respective elements of these circuits.

Moreover, it will be appreciated that method steps and apparatus features may be interchanged in many ways. In particular, the details of the disclosed method can be implemented as an apparatus adapted to execute some or all or the steps of the method, and vice versa, as the skilled person will appreciate. In particular, it is understood that methods according to the disclosure relate to methods of operating the circuits according to the above embodiments and variations thereof, and that respective statements made with regard to the circuits likewise apply to the corresponding methods.

It is also understood that in the present document, the term "couple" or "coupled" refers to elements being in electrical communication with each other, whether directly connected e.g., via wires, or in some other manner.

BRIEF DESCRIPTION OF THE DRAWINGS

Example embodiments of the disclosure are explained below with reference to the accompanying drawings, wherein like reference numbers indicate like or similar elements, and wherein FIG. 1 schematically illustrates an example of a circuit for generating an output voltage and regulating the output voltage to a target voltage, embodying the principles of the disclosure.

DESCRIPTION

Figure 1:
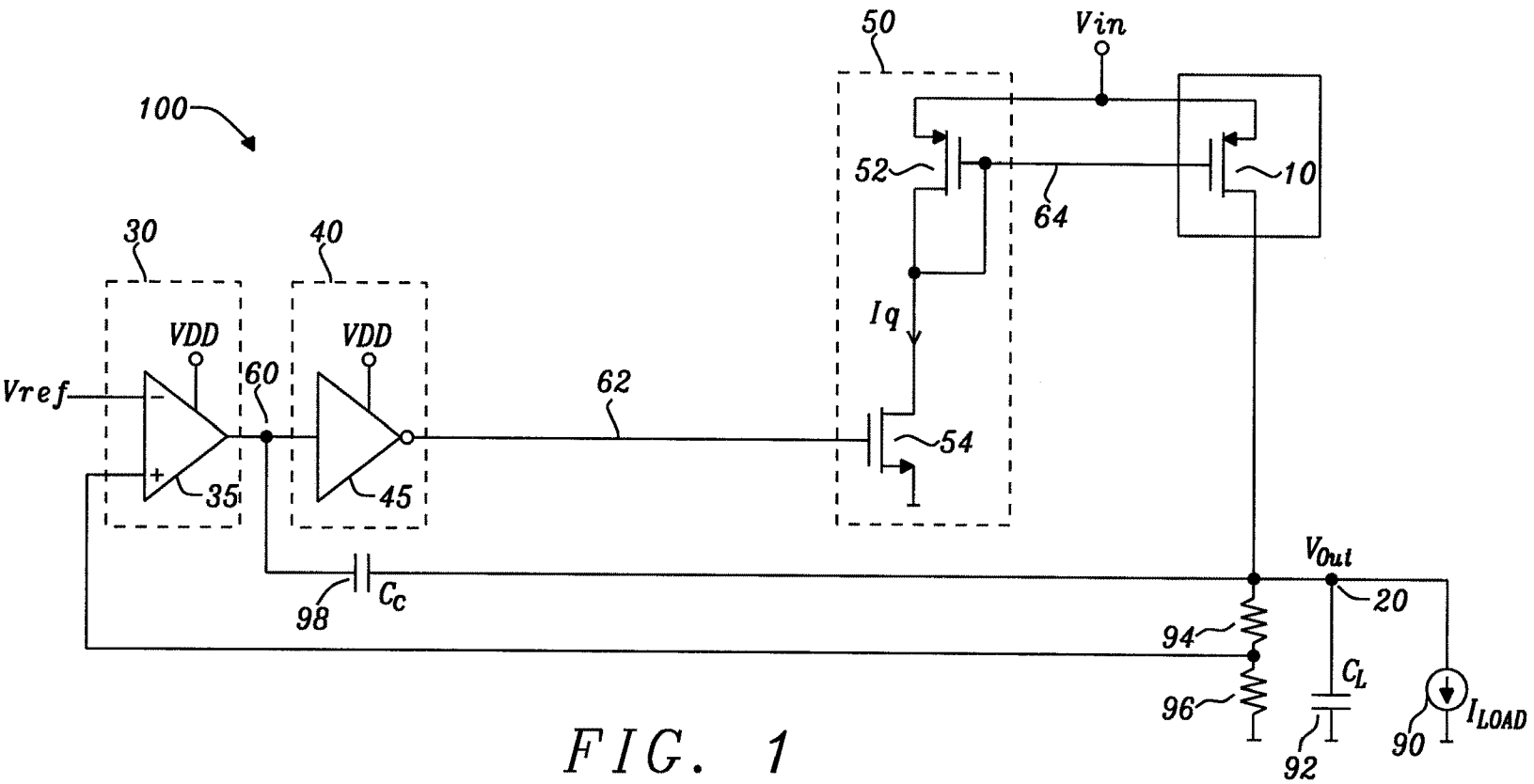

An example of a circuit (voltage regulator, i.e., circuit for generating an output voltage and regulating the output voltage to a target voltage) 100, embodying the principles of the disclosure, is schematically illustrated in FIG. 1. This figure shows a generic PMOS LDO structure. The voltage regulator 100 includes a pass device (e.g., output pass device) 10 coupled (e.g., connected) between an input voltage level (input voltage) $V_{in}$ and an output voltage level (output voltage) $V_{out}$. For example, the pass device 10 may be coupled between the input voltage level $V_{in}$ and an output node 20 of the voltage regulator 100. In general, the pass device 10 may be a MOS, such as a MOSFET, for example. For the PMOS LDO structure, the pass device 10 may be a PMOS transistor.

The voltage regulator 100 further includes an error amplifier stage 30 having an error amplifier 35 and a buffer stage (e.g., current buffer) 50 coupled (e.g. connected) in series. The error amplifier stage 30 generates a first control voltage 60 on the basis of a reference voltage $V_{ref}$ (e.g., a reference voltage depending on a target voltage for the output voltage $V_{out}$) and the output voltage $V_{out}$. For example, the error amplifier stage 30 may generate the first control voltage 60 based on the reference voltage $V_{ref}$ and a feedback voltage that is in a certain ratio to the output voltage $V_{out}$. The feedback voltage may be tapped at a voltage divider that comprises a plurality of resistance elements (e.g., resistors) 94, 96 and that is coupled (e.g., connected) between the output voltage and ground.

The buffer stage 50 receives the first control voltage 60 (or a voltage 62 that depends on the first control voltage 60) as an input and is thus controlled by the first control voltage 60

(or, in more general terms, by the error amplifier stage 30). The buffer stage 50 generates a drive signal 64 for the pass device 10. In particular, the buffer stage 50 generates a drive signal 64 for the pass device 10 based on the first control voltage 60.

The buffer stage 50 comprises a first transistor 52 and a second transistor 54 that are coupled (e.g., connected) in series. The first transistor 52 forms a current mirror with the pass device 10. A voltage 62 depending on the first control voltage 60 is supplied to a control terminal (e.g., gate terminal) of the second transistor 54. Alternatively, the first control voltage 60 may be directly supplied to the control terminal of the second transistor 54. For the PMOS LDO shown in FIG. 1, the first transistor 52 is a PMOS transistor, and the second transistor 54 is an NMOS transistor.

The voltage regulator 100 may further comprise an intermediate stage 40 including an inverter 45 coupled in series between the error amplifier stage 30 and the buffer stage 50. The intermediate stage 40 may receive the first control voltage 60 and output the voltage 62 that depends on the first control voltage 60. An intermediate node between the error amplifier stage 30 and the intermediate stage 40 may be coupled (e.g., connected) to the output node 20 through a capacitor 98.

An output capacitor 92 may be coupled (e.g., connected) to the output node 20. The output node 20 may provide the output voltage $V_{out}$ to an electric load 90.

Figure 2:
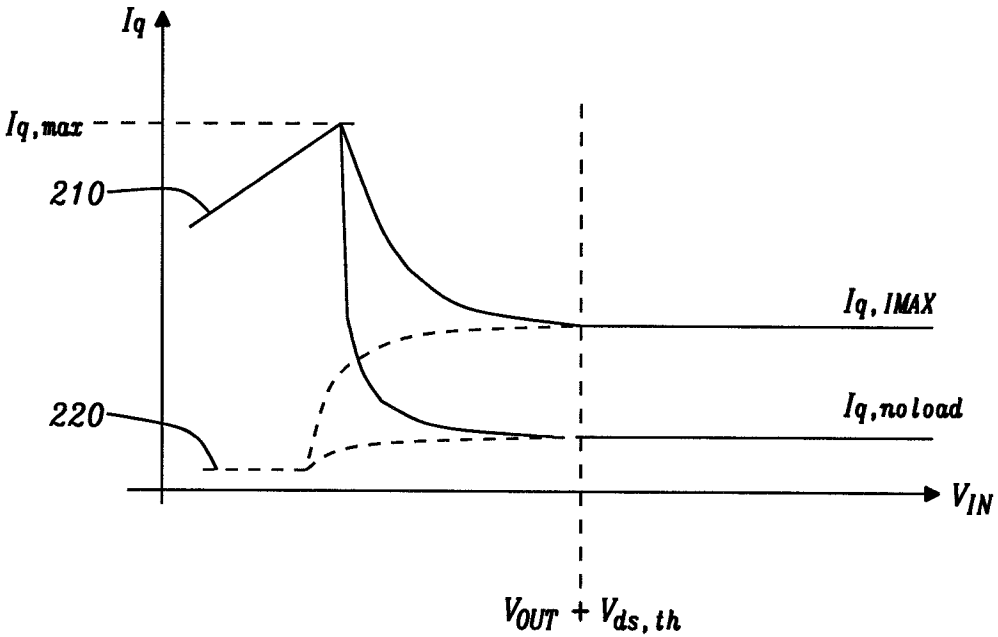
FIG. 2 schematically illustrates the quiescent current of the circuit of FIG. 1.

In the above configuration, the quiescent current $I_q$ of the buffer stage (current buffer) 50 is proportional to the load current $I_{LOAD}$ if the input voltage $V_{in}$ is high enough (e.g., >200 mV). In this case, the quiescent current $I_q$ is defined by the mirror ratio of the first transistor 52 and the pass device 10. As the input voltage $V_{in}$ starts to drop below a certain threshold (e.g., defined by $V_{out}+V_{ds,th}$), the quiescent current $I_q$ increases uncontrolled to its maximum value. This is shown in FIG. 2, in which curves 210 indicate the quiescent current $I_q$ for the voltage regulator 100 of FIG. 1 for maximum output current $I_{MAX}$ (upper curve) and for the no load condition (lower curve), and curves 220 indicate the desired quiescent currents $I_q$ under the aforementioned conditions. As the input voltage $V_{in}$ continues to decrease further, the quiescent current $I_q$ will reach its peak value $I_{q,max}$, which is defined by the maximum current capability of the first and second transistors 52, 54. Notably, this peak value is far beyond the quiescent current $I_q$ in the normal operation region. This heavily disrupts the power efficiency of the LDO for input voltages $V_{in}$ below the threshold value, e.g., for $V_{in}<V_{OUT}+V_{ds,th}$. Typically, $V_{ds,th}<200$ mV. Furthermore, the peak value $I_{q,max}$ point is not dependent on the current load $I_{LOAD}$ of the LDO. As can be also seen from FIG. 2, the two $I_q$ curves 210, i.e., at maximum load $I_{q,IMAX}$ and at no load $I_{q,noload}$, converge in the same $I_{q,max}$, which even more reduces power efficiency for input voltages $V_{in}$ below the threshold.

Broadly speaking, the present disclosure seeks to control the quiescent current $I_q$ of the LDO to keep the quiescent $I_q$ of the LDO proportional to the load current $I_{LOAD}$ in all modes of operation, and to guarantee optimal power efficiency of the LDO. In other words, the present disclosure seeks to control the quiescent current to have characteristics as illustrated by curves 220 in FIG. 2.

Figure 3:
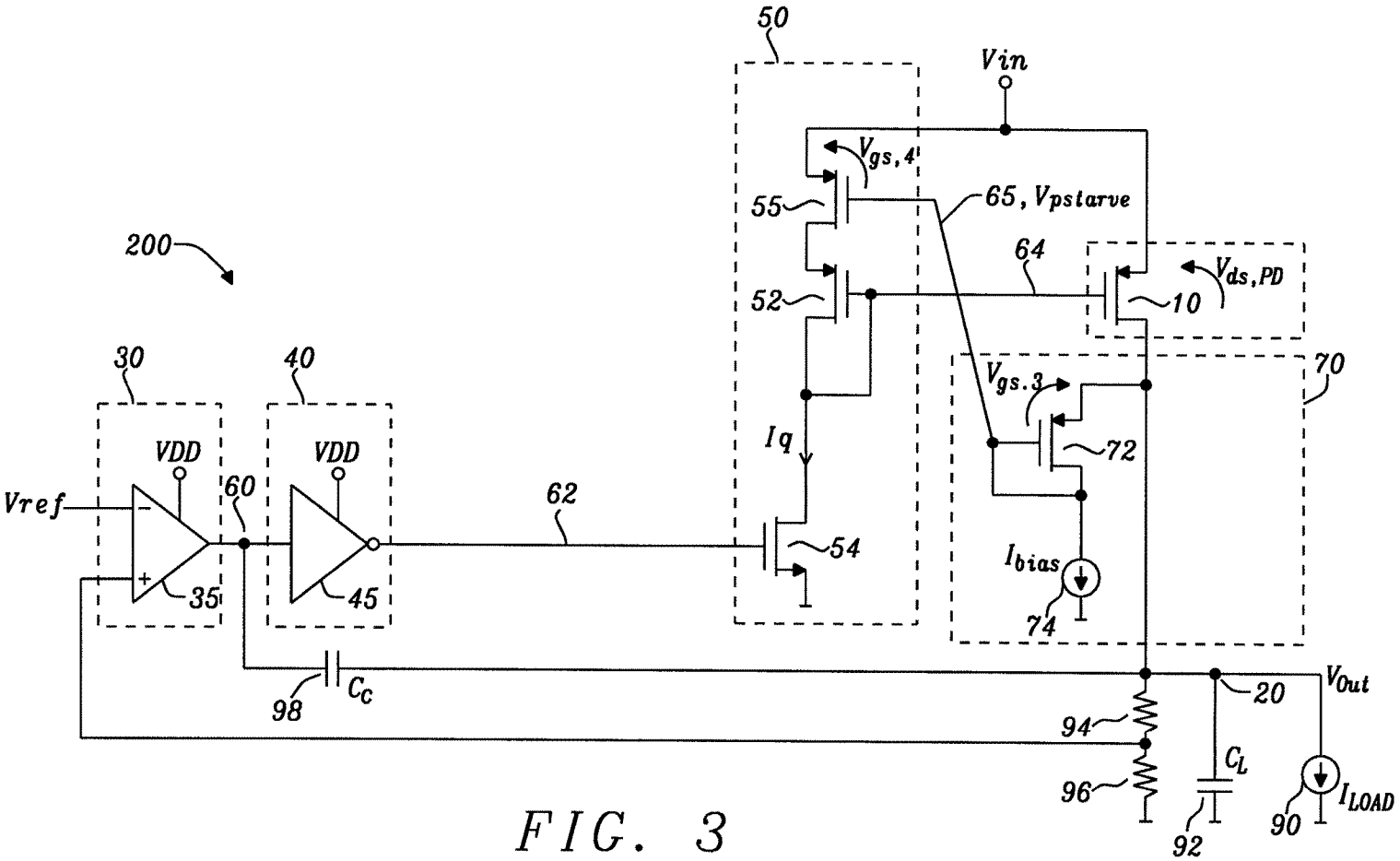
FIG. 3 schematically illustrates an example of a circuit for generating an output voltage and regulating the output voltage to a target voltage, according to embodiments of the disclosure.

FIG. 3 schematically illustrates an example of a circuit 200 for generating an output voltage and regulating the output voltage to a target voltage, according to embodiments of the disclosure. In the following, only elements that differ from elements already shown in FIG. 1 will be described, and repeated description of the other elements will be omitted for reasons of conciseness.

FIG. 3 shows a generic PMOS LDO structure that includes, as the buffer stage 50, a starved current mode buffer (SCB) for $I_q$ control. The buffer stage 50 now includes, in addition to the first and second transistors 52, 54, a variable resistance element 55 that is placed in series with the first and second transistors 52, 54. Thus, the buffer stage may be said to comprise a (first) circuit branch that includes the first transistor 52, the second transistor 54 and the variable resistance element 55 coupled (e.g., connected) in series (not necessarily in this order). As will be described in more detail below, the variable resistance element 55 has a function of limiting a current that flows through the buffer stage 50.

The circuit 200 further comprises a tracking circuit (e.g., VDS tracking circuit) 70 for tracking a voltage across the pass device 10 (e.g., the drain-source voltage $V_{ds}$ of the pass device 10). The tracking circuit further has a function of generating a second control voltage (e.g., starve voltage $V_{pstarve}$) 65 on the basis of (e.g., depending on) the voltage across the pass device 10. The variable resistance element 55 is controlled by the second control voltage 65, i.e., the variable resistance element 55 limits the current flowing through the buffer stage 50 based on (e.g., depending on) the second control voltage 65.

The tracking circuit 70 may comprise a third transistor 72 and a current source (e.g., bias current source) 74 that are coupled (e.g., connected) in series (not necessarily in this order) between a drain terminal of the pass device 10 and a predetermined voltage level. The current source 74 may generate a bias current for the third transistor 72. The control terminal (e.g., gate terminal) and the drain terminal of the third transistor 72 may be coupled (e.g., connected) to each other. The second control voltage ($V_{pstarve}$) 65 may be tapped at the gate terminal of the third transistor 72. In this configuration, the second control voltage 65 is given by $V_{pstarve}=V_{in}+V_{ds,PD}+V_{gs,3}$, where $V_{in}$ is the input voltage, $V_{ds,PD}$ is the voltage across the pass device 10 (e.g., the drain-source voltage of the pass device 10), and $V_{gs,3}$ is the gate-source voltage of the third transistor 72. Thus, the second control voltage 65 may be said to track the voltage across the pass device 10. The gate-source voltage $V_{gs,3}$ of the third transistor 72 is fixed and defined by the bias current $I_{bias}$ generated by the current source 74.

In various embodiments, the variable resistance element 55 may be a (fourth) transistor, and the second control voltage 65 may be supplied (e.g., fed, or provided) to a control terminal (e.g., gate terminal) of the fourth transistor 55. To this end, the gate terminals of the third and fourth transistors 72, 55 may be coupled (e.g., connected) to each other.

Then, the gate-source voltage $V_{gs,4}$ of the fourth transistor 55 is linearly dependent on the voltage $V_{ds,PD}$ across the pass device 10. The voltage $V_{ds,PD}$ across the pass device 10 is the difference between the output voltage $V_{out}$ and the input voltage $V_{in}$, $V_{ds,PD}=V_{in}-V_{out}$.

For $V_{in}>>V_{out}+V_{ds,th}$, the fourth transistor 55 is in the linear region and acts as a serial resistor since its $|V_{gs,4}|>>|V_{ds,4}|$. As the input voltage $V_{in}$ starts to approach the output voltage $V_{out}$, the gate-source voltage of the fourth transistor 55 will be reduced and the resistance value of the fourth transistor 55 is slightly increasing, thereby reducing the quiescent current $I_q$ in the buffer stage 55. For $V_{in}\leq V_{out}+V_{ds,th}$, the fourth transistor 55 will change its operation region from linear region to saturation region, and therefore the current in the buffer stage 55 will rapidly drop to its minimum value. The lowest value of the quiescent current $I_q$ is defined by the current mirror ratio of the fourth transistor 55 and the third transistor 72.

In general, the resistance value of the variable resistance element (e.g., fourth transistor) 55 may be said to depend on the second control voltage 65. In particular, the resistance value may be inversely correlated with the second control voltage 65 (i.e., inversely correlated with the voltage across the pass device 10). Thus, the resistance value may increase for decreasing voltage across the pass device 10, and vice versa.

Simulation results have shown that for $V_{in} >> V_{out}$ there is no difference in quiescent current $I_q$ between the circuit 100 in FIG. 1 and the proposed circuit 200 in FIG. 3. However, as the input voltage $V_{in}$ starts to approach the output voltage $V_{out}$, the quiescent current $I_q$ of the circuit 100 rapidly increases to its maximum value independently of the load condition. For the proposed circuit 200, the gate-source voltage $|V_{gs,4}|$ of the fourth transistor 55 starts to decrease as $V_{in}$ approaches $V_{out}$ so that the fourth transistor 55 reduces (starves) the quiescent current $I_q$ in the buffer stage 50. If $V_{in}$ continues to decrease, $I_q$ is further reduced until it reaches its minimum value. Furthermore, the value of $I_q$ for $V_{in}$ close to $V_{out}$ is now dependent on the load current $I_{LOAD}$, which improves the power efficiency of the circuit 200 even more compared to the circuit 100.

For the case of a PMOS LDO structure (illustrated, e.g., in FIG. 3), the pass device 10 is a PMOS transistor, and the first, third, and fourth transistors 52, 72, 55 are PMOS transistors as well. The second transistor 54 is an NMOS transistor. The first circuit branch including the first, second and fourth transistors 52, 54, 55 may be coupled (e.g., connected) between a supply voltage (e.g., the input voltage $V_{in}$) and ground. Further, the predetermined voltage level may be ground. That is, the third transistor 72 and the current source 74 may be coupled (e.g., connected) between the drain terminal of the pass device 10 and ground. For an NMOS LDO as described further below, the predetermined voltage level may be a supply voltage (supply voltage level; e.g., $V_{dd}$).

In the example of FIG. 3, the fourth transistor 55, the first transistor 52, and the second transistor 54 are coupled (e.g., connected), in this order, between the supply voltage (e.g., the input voltage $V_{in}$) and ground. That is, the fourth transistor 55 is coupled (e.g., connected) between a source terminal of the first transistor 52 and the supply voltage (e.g., the input voltage $V_{in}$).

With the fourth transistor 55 placed (e.g., arranged) in the source of the first transistor 52, the voltage $|V_{ds,4,min}|$, which defines the voltage threshold for the drain-source voltage of the fourth transistor 55 at which the fourth transistor 55 goes from the linear region to the saturation region, is given by the on-state resistance $R_{ds,4,on}$ of the fourth transistor 55 times the quiescent current $I_q$, i.e., $|V_{ds,4,min}|=R_{ds,4,on}\times I_q$. In typical implementations, this will yield a voltage $|V_{ds,4,min}|$ of approximately 0.2 V. Notably, for a configuration in which the fourth transistor 55 were placed in the drain of the first transistor 52 (e.g., a configuration in which the fourth transistor 55 is coupled between the drain terminal of the first transistor 52 and the drain terminal of the second transistor 54) rather than in the source of the first transistor 52, the voltage $|V_{ds,4,min}|$ would be given by the gate-source voltage $V_{gs,1}$ of the first transistor 52, which would yield a significantly higher value (e.g., approximately 0.5 V in typical implementations). The lower the voltage $|V_{ds,4,min}|$, the lower the input voltage $V_{in}$ at which the fourth transistor 55 starts limiting the quiescent current $I_q$. Accordingly, the circuit 200 in the example of FIG. 3 will start limiting the quiescent current $I_q$ at a lower input voltage $V_{in}$ compared to a similar circuit in which the fourth transistor 55 is arranged in the drain of the first transistor 52, thereby impacting operation of the LDO as little as possible for input voltages $V_{in}$ above the output voltage $V_{out}$.

To guarantee stable behavior of the LDO, the current in the buffer stage 50 should only be limited if the pass device 10 is in the linear region. This can be ensured by placing (e.g., arranging) the fourth transistor 55 in the source of the first transistor 52, as shown in the example of FIG. 3. The reason is that for the placement of the fourth transistor 55 shown in the example of FIG. 3 the quiescent current is limited at lower voltages of the input voltage $V_{in}$ compared to a similar circuit in which the fourth transistor 55 is arranged in the drain of the first transistor 52.

Figure 4:
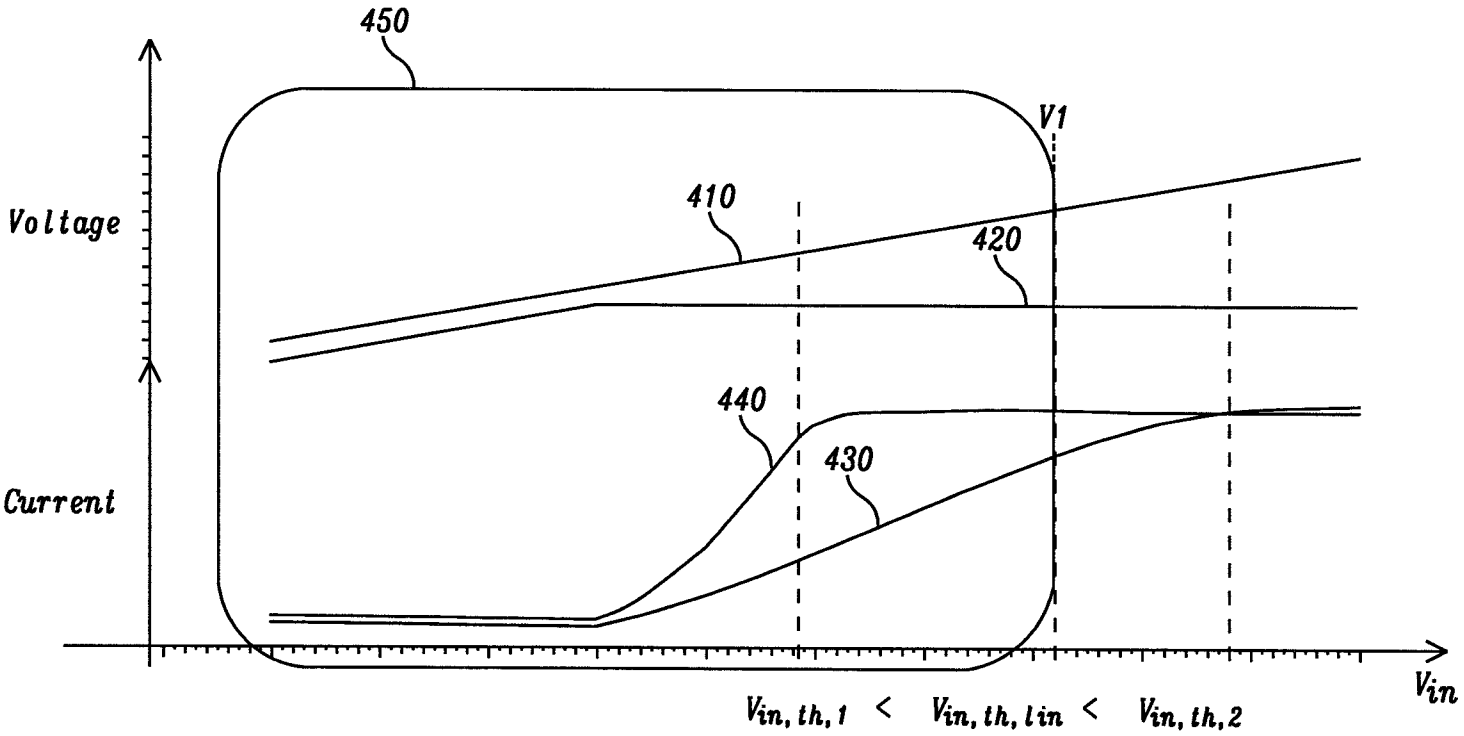
FIG. 4 schematically illustrates an example of a graph indicating a quiescent current in dependence on the input voltage, according to embodiments of the disclosure.

This is also shown in FIG. 4, which schematically illustrates a graph 410 indicating the input voltage $V_{in}$, a graph 420 indicating the output voltage $V_{out}$, a graph 430 indicating the quiescent current $I_q$ if the fourth transistor 55 is placed in the source of the first transistor 52, and a graph 440 indicating the quiescent current $I_q$ if the fourth transistor 55 is placed in the drain of the first transistor 52, each in dependence on the input voltage $V_{in}$. Box 450 indicates the voltage range for which the pass device 10 is in the linear region, and $V_{in,th,lin}$ indicates the voltage threshold at which the pass device 10 goes from the linear region to the saturation region. Further, $V_{in,th,1}$ indicates a first voltage threshold at which the quiescent current $I_q$ starts to be reduced or limited if the fourth transistor 55 is placed in the source of the first transistor 52, and $V_{in,th,2}$ indicates a second voltage threshold at which the quiescent current $I_q$ starts to be reduced or limited if the fourth transistor 55 is placed in the drain of the first transistor 52. As can be seen from FIG. 4, the first voltage threshold $V_{in,th,1}$ falls into the voltage range in which the pass device 10 is in the linear region, whereas the second voltage threshold $V_{in,th,2}$ falls into the voltage range in which the pass device 10 is in the saturation region. Reducing or limiting the quiescent current $I_q$ while the pass device 10 is still in the saturation region may cause stability issues.

As noted above, the quiescent current $I_q$ should only be limited if the pass device 10 is in the linear region (i.e., not in the saturation region anymore). This can be achieved by placing the fourth transistor 55 in the source of the first transistor 52, as illustrated in the example of FIG. 3, thereby improving stability of the LDO.

The above concept for reducing (starving) the quiescent current $I_q$ is generally applicable to LDO structures. Examples that illustrate application of the above concept to NMOS LDO structures will be described next.

Figure 5:
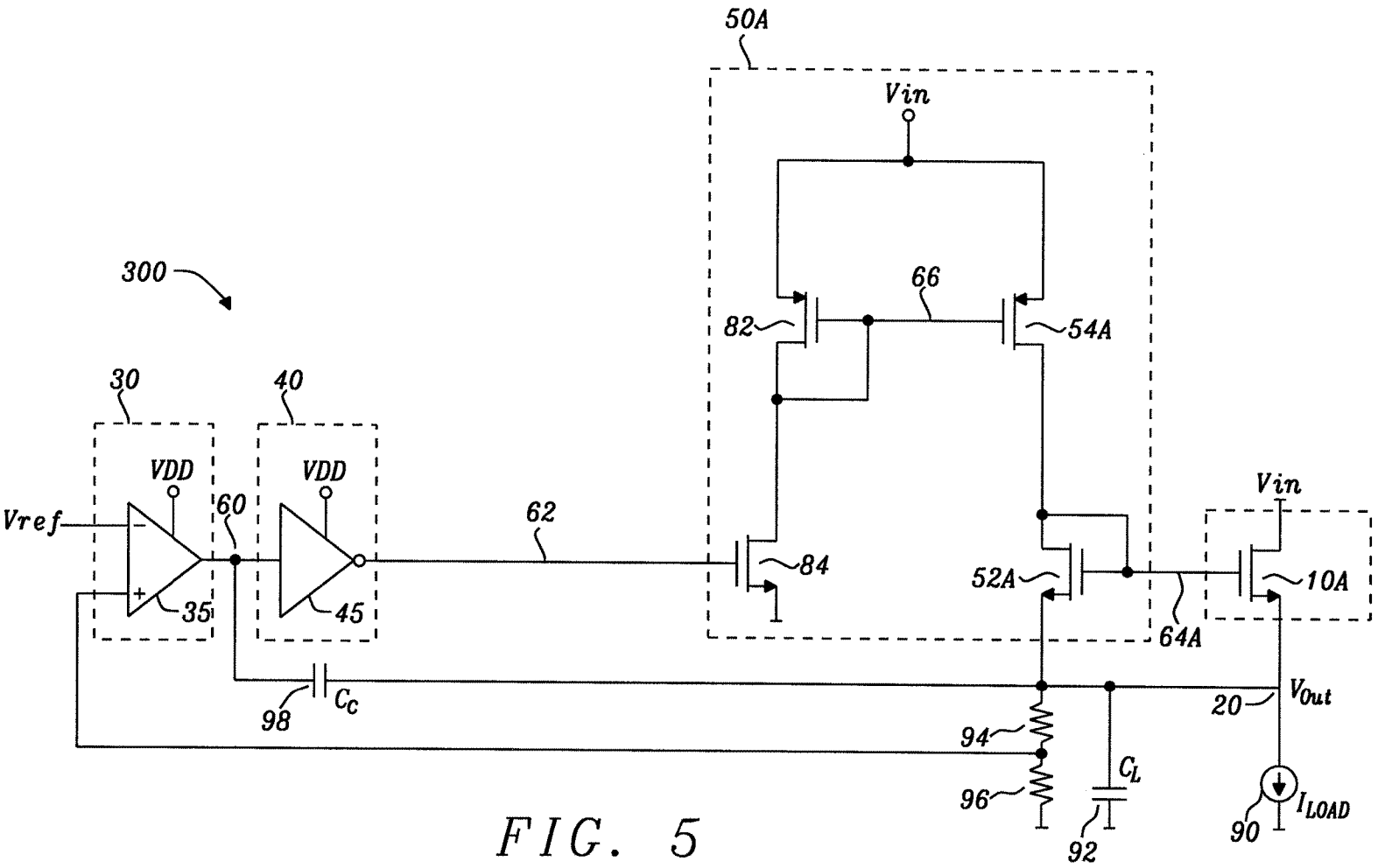
FIG. 5 schematically illustrates another example of a circuit for generating an output voltage and regulating the output voltage to a target voltage, according to embodiments of the disclosure.

FIG. 5 schematically illustrates another example of a circuit 300 for generating an output voltage and regulating the output voltage to a target voltage, according to embodiments of the disclosure. This figure shows a generic NMOS LDO structure. Now, the pass device (e.g., output pass device) 10A is an NMOS transistor. Further, the circuit 300 comprises a buffer stage (current buffer) 50A that differs from buffer stage 50 of circuit 100 in FIG. 1, as will be explained in more detail below. Otherwise, the circuits 100 and 300 may be identical.

Also here, the buffer stage 50A generates a drive signal 64A for the pass device 10A based on the first control voltage 60. Further, the buffer stage 50A comprises a first circuit branch coupled (e.g., connected) between a supply voltage (e.g., $V_{dd}$) and ground. For example, the first circuit branch may be coupled (e.g., connected) between the supply voltage and the output voltage $V_{out}$. The first circuit branch comprises a first transistor 52A and a second transistor 54A that are coupled (e.g., connected) in series. The first transistor 52A forms a current mirror with the pass device 10A. A voltage 66 depending on the first control voltage 60 is supplied to a control terminal (e.g., gate terminal) of the second transistor 54A. For the NMOS LDO shown in FIG. 5, the first transistor 52A is an NMOS transistor, and the second transistor 54A is a PMOS transistor. The control (e.g., gate) and drain terminals of the first transistor 52A are coupled (e.g., connected) to each other.

To adapt to the NMOS pass device 10A, the buffer stage 50A further comprises a second circuit branch coupled (e.g., connected) between the supply voltage (e.g., $V_{dd}$) and ground. For example, the second circuit branch may be coupled (e.g., connected) between the supply voltage and the output voltage $V_{out}$. The second circuit branch comprises a fifth transistor 82 and a sixth transistor 84 coupled (e.g., connected) in series (not necessarily in this order). The fifth transistor 82 forms a current mirror with the second transistor 54A. The first control voltage 60 (or a voltage 62 that depends on the first control voltage 60) is supplied to a control terminal (e.g., gate terminal) of the sixth transistor 84. For the NMOS LDO shown in FIG. 5, the fifth transistor 82 is a PMOS transistor, and the sixth transistor 84 is an NMOS transistor. The control (e.g., gate) and drain terminals of the fifth transistor 82 are coupled (e.g., connected) to each other. In summary, the current buffer 50A now comprise the first, second, fifth and sixth transistors 52A, 54A, 82, 84 to fit to the NMOS pass device 10A.

Figure 6:
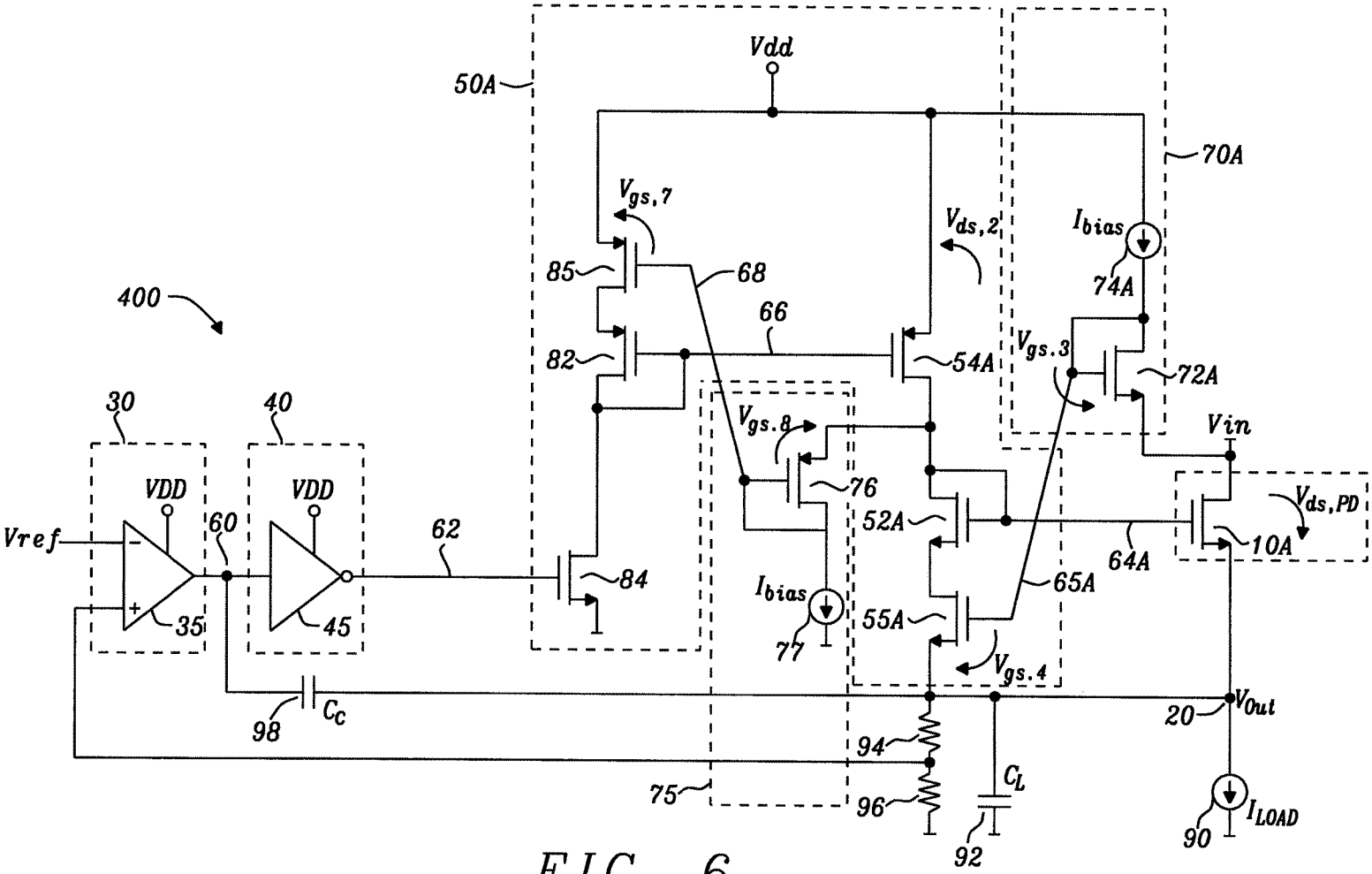
FIG. 6 schematically illustrates another example of a circuit for generating an output voltage and regulating the output voltage to a target voltage, according to embodiments of the disclosure.

FIG. 6 schematically illustrates an example of a circuit 400 for generating an output voltage and regulating the output voltage to a target voltage, according to embodiments of the disclosure. In the following, only elements that differ from elements already shown in FIG. 5 will be described, and repeated description of the other elements is omitted for reasons of conciseness.

FIG. 6 shows a generic NMOS LDO structure that includes, as the buffer stage 50A, a starved current mode buffer for $I_q$ control. The buffer stage 50A now includes, in addition to the first, second, fifth and sixth transistors 52A, 54A, 82, 84 a variable resistance element 55A that is placed in series with the first and second transistors 52A, 54A. Thus, the first circuit branch includes the first transistor 52A, the second transistor 54A and the variable resistance element 55A coupled (e.g., connected) in series (not necessarily in this order). As will be described in more detail below, the variable resistance element 55A has a function of limiting a current that flows through the first circuit branch.

The circuit 400 further comprises a (first) tracking circuit 70A for tracking a voltage across the pass device 10A (e.g., the drain-source voltage $V_{ds}$ of the pass device 10A). The first tracking circuit 70A (e.g., a pdrive VDS tracking circuit) further has a function of generating a second control voltage 65A on the basis of (e.g., depending on) the voltage across the pass device 10A. The variable resistance element 55A is controlled by the second control voltage 65A, i.e., the variable resistance element 55A limits the current flowing through the first circuit branch (more generally, through the buffer stage 50A) based on (e.g., depending on) the second control voltage 65A.

The first tracking circuit 70A may comprise a third transistor 72A and a current source (e.g., bias current source) 74A that are coupled (e.g., connected) in series (not necessarily in this order) between a drain terminal of the pass device 10A and a predetermined voltage level. The current source 74A may generate a bias current for the third transistor 72A. The control terminal (e.g., gate terminal) and the drain terminal of the third transistor 72A may be coupled (e.g., connected) to each other. The second control voltage 65A may be tapped at the gate terminal of the third transistor 72A. The second control voltage 65A may be said to track the voltage across the pass device 10A. The gate-source voltage $V_{gs,3}$ of the third transistor 72A is fixed and defined by the bias current $I_{bias1}$ generated by the current source 74A. Operation of the tracking circuit 70A in circuit 400 is analogous to that of the tracking circuit 70 in circuit 200 described above.

In embodiments, the variable resistance element 55A may be a (fourth) transistor, and the second control voltage 65A may be supplied (e.g., fed, or provided) to a control terminal (e.g., gate terminal) of the fourth transistor 55A. To this end, the gate terminals of the third and fourth transistors 72A, 55A may be coupled (e.g., connected) to each other.

Then, the gate-source voltage $V_{gs,4}$ of the fourth transistor 55A is linearly dependent on the voltage $V_{ds,PD}$ across the pass device 10A. The voltage $V_{ds,PD}$ across the pass device 10A is the difference between the output voltage $V_{out}$ and the input voltage $V_{in}$, $V_{ds,PD}=V_{in}-V_{out}$.

Operation of the fourth transistor 55A is analogous to that of the fourth transistor 55 in circuit 200 of FIG. 3 described above.

For limiting a current that flows through the second circuit branch, the second circuit branch comprises, in addition to the fifth and sixth transistors 82, 84 also a seventh transistor 85 that acts as a second variable resistance element. Operation of the seventh transistor 85 will be described below.

For the case of an NMOS LDO structure (illustrated, e.g., in FIG. 6), the pass device 10A is an NMOS transistor, and the first, third, and fourth transistors 52A, 72A, 55A are NMOS transistors as well. The second transistor 54A is a PMOS transistor. The first circuit branch including the first, second and fourth transistors 52A, 54A, 55A may be coupled (e.g., connected) between the supply voltage (e.g., $V_{dd}$) and ground (e.g., between the supply voltage and the output voltage). The second transistor 54A, the first transistor 52A, and the fourth transistor 55A may be coupled (e.g., connected), in this order, between the supply voltage (e.g., $V_{dd}$) and ground (e.g., between the supply voltage and the output voltage). That is, the fourth transistor 55A may be coupled (e.g., connected) between a source terminal of the first transistor 52A and ground. Further, the predetermined voltage level may be the supply voltage (e.g., $V_{dd}$). That is, the third transistor 72A and the current source 74A may be coupled (e.g., connected) between the drain terminal of the pass device 10A and the supply voltage.

In the example of FIG. 6, the fifth, sixth, and seventh transistors 82, 84, 85 are coupled (e.g., connected) in series. In particular, the seventh transistor 85 is a PMOS transistor that is coupled (e.g., connected) between the supply voltage and a source terminal of the fifth transistor 82. The circuit 400 further comprises a second tracking circuit (e.g., a pdrive VDS tracking circuit) 75 for tracking a voltage across the second transistor 54A and for generating a third control voltage 68 for controlling the seventh transistor 85. The second tracking circuit 75 comprises an eighth transistor 76 (a PMOS transistor) and a second current source (e.g., bias current source) 77 that are coupled (e.g., connected) (not necessarily in this order) between a drain terminal of the second transistor 54A and ground. The third control voltage 68 may be said to track the voltage across the second transistor 54A. Operation of the second tracking circuit 75 is analogous to that of tracking circuit 70 in circuit 200 and tracking circuit 70A in circuit 400. The third control voltage 68 is supplied to the control terminal (e.g., gate terminal) of the seventh transistor 85.

The circuit 400 of FIG. 6 implements the concept of the present disclosure for an NMOS LDO structure. There are two additional VDS tracking circuits 70A and 75 with the corresponding current starving transistors 55A and 85 required to control the quiescent current $I_q$ for the NMOS LDO. As the $V_{ds}$ voltage of the pass device 10A decreases below a certain threshold, the starving transistors 55A and 85 will reduce the quiescent current $I_q$ of the current buffer in the same manner as for the PMOS LDO structure in FIG. 3.

In the example of FIG. 6, the seventh transistor 85 is a PMOS transistor that is coupled (e.g., connected) between the supply voltage and a source terminal of the fifth transistor 82. Further, the third control voltage 68 generated by the second tracking circuit 75 is supplied to the gate terminal of the seventh transistor 85 for controlling the seventh transistor 85.

The concepts described in the present disclosure are generally applicable to voltage regulator configurations (e.g., LDO configurations) including a buffer stage.

Unless indicated otherwise, elements of a series connection of two or more elements may be coupled (e.g., connected) to each other in any order, not just the order explicitly stated.

It should be noted that the apparatus features described above correspond to respective method features that may however not be explicitly described, for reasons of conciseness. The disclosure of the present document is considered to extend also to such method features. In particular, the present disclosure is understood to relate to methods of operating the circuits described above.

Figure 7:
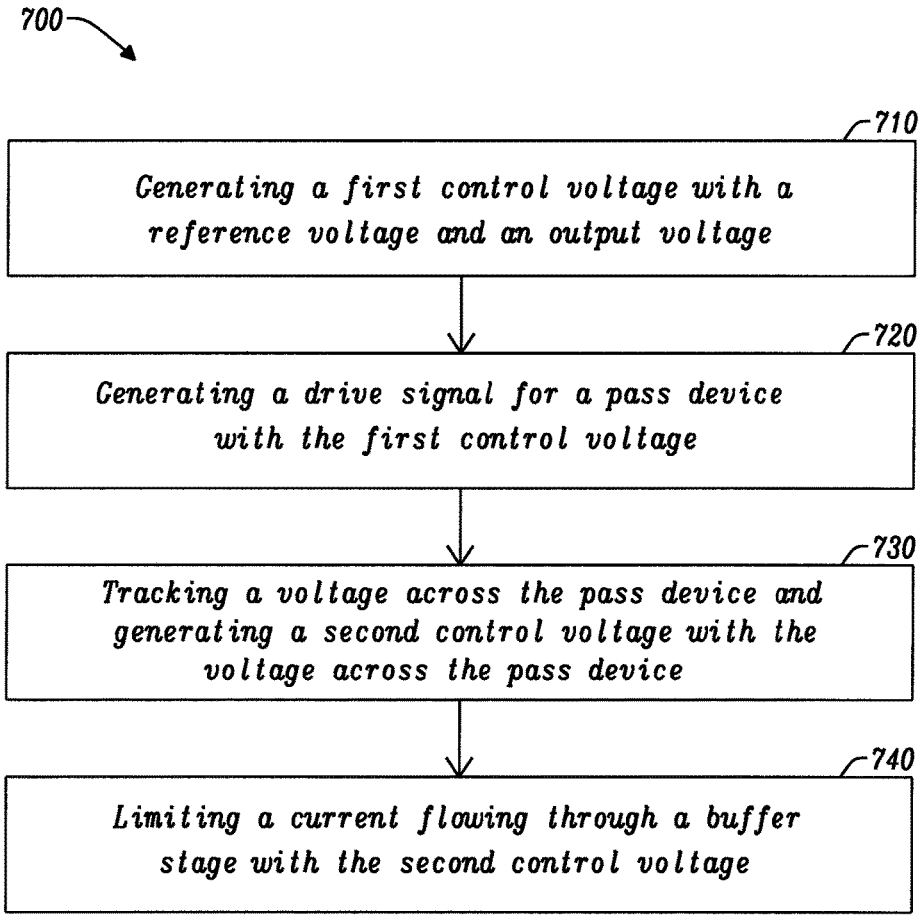
FIG. 7 shows a flow chart of a method of quiescent current control in a voltage regulator, embodying the principles of the disclosure.

FIG. 7 shows a flow chart of a method of quiescent current control in a voltage regulator, embodying the principles of the disclosure. The method 700 comprises generating 710 a first control voltage with a reference voltage and an output voltage. Furthermore, the method 700 comprises generating 720 a drive signal for a pass device with a first control voltage. In addition, the method 700 comprises tracking 730 a voltage across the pass device and generating a second control voltage with the voltage across the pass device. The method 700 also comprises limiting 740 a current flowing through a buffer stage with the second control voltage.

It should further be noted that the description and drawings merely illustrate the principles of the proposed apparatus. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed method. Furthermore, all statements herein providing principles, aspects, and embodiments of the invention, as well as specific examples thereof, are intended to encompass equivalents thereof.

What is claimed is:

1. A circuit for generating an output voltage and regulating the output voltage to a target voltage, the circuit comprising:

a pass device coupled between an input voltage level and an output voltage level;

an error amplifier stage configured to generate a first control voltage with a reference voltage and the output voltage;

a buffer stage configured to generate a drive signal for the pass device with the first control voltage; and a tracking circuit configured to track a voltage across the pass device and to generate a second control voltage with the voltage across the pass device, wherein the buffer stage comprises a variable resistance element for limiting a current flowing through the buffer stage with the second control voltage, the variable resistance element comprises a fourth transistor; and the second control voltage is configured to supply a gate terminal of the fourth transistor, the pass device, a first transistor, a third transistor, and the fourth transistor comprise NMOS transistors and a second transistor comprises a PMOS transistor; the first, second, and fourth transistors are coupled in series between a supply voltage level and the output voltage level; and the third transistor and a current source are coupled in series between a drain terminal of the pass device and the supply voltage level, and the buffer stage further comprises a second circuit branch comprising a fifth transistor, a sixth transistor, and a seventh transistor coupled in series; the second circuit branch further comprises a second tracking circuit for tracking a voltage across the second transistor and for generating a third control voltage on the basis of the voltage across the second transistor; the fifth transistor comprises a PMOS transistor, and is configured to form a current mirror with the second transistor; the sixth transistor comprises an NMOS transistor, and a second voltage, configured to depend on the first control voltage, is configured to supply a gate terminal of the sixth transistor; and the seventh transistor comprises a PMOS transistor, and a third control voltage is configured to supply a gate terminal of the seventh transistor.

2. The circuit of claim 1, wherein the buffer stage further comprises:

a circuit branch comprising a first transistor and a second transistor coupled in series with the variable resistance element, wherein the first transistor is configured to form a current mirror with the pass device; and a first voltage, configured to depend on the first control voltage, is configured to supply a gate terminal of the second transistor.

3. The circuit of claim 1, wherein the tracking circuit comprises:

a third transistor and a current source coupled in series between a drain terminal of the pass device and a predetermined voltage level, wherein a gate terminal and a drain terminal of the third transistor are coupled to each other, and the second control voltage is generated at the gate terminal of the third transistor.

4. The circuit of claim 1, wherein the fourth transistor is coupled between a source terminal of the first transistor and the output voltage level; and gate and drain terminals of the first transistor are coupled to each other.

5. A method of operating a circuit for generating an output voltage and regulating the output voltage to a target voltage, wherein the circuit comprises a pass device coupled between an input voltage level and an output voltage level, the method comprising:

generating a first control voltage on the basis of a reference voltage and the output voltage with an error amplifier stage;

generating a drive signal for the pass device on the basis of the first control voltage with a buffer stage;

tracking a voltage across the pass device and generating a second control voltage on the basis of the voltage across the pass device with a tracking circuit; and limiting a current flowing through the buffer stage on the basis of the second control voltage with a variable resistance element included in the buffer stage, wherein the variable resistance element is a fourth transistor; and the method further comprises supplying the second control voltage to a gate terminal of the fourth transistor, wherein the pass device, a first transistor, a third transistor, and the fourth transistor comprise NMOS transistors and a second transistor comprises a PMOS transistor; the first, second, and fourth transistors are coupled in series between a supply voltage level and the output voltage level; and the third transistor and a current source are coupled in series between a drain terminal of the pass device and the supply voltage level, and wherein the buffer stage further comprises a second circuit branch comprising a fifth transistor, a sixth transistor, and a seventh transistor coupled in series; the fifth transistor comprises a PMOS transistor and forms a current mirror with the second transistor; the sixth transistor comprises an NMOS transistor and the seventh transistor comprises a PMOS transistor; and the method further comprises: tracking a voltage across the second transistor and generating a third control voltage on the basis of the voltage across the second transistor with a second tracking circuit; supplying a second voltage depending on the first control voltage to a gate terminal of the sixth transistor; and supplying the third control voltage to a gate terminal of the seventh transistor.

6. The method of claim 5, wherein the buffer stage further comprises a circuit branch comprising a first transistor and a second transistor coupled in series with the variable resistance element;

wherein the first transistor forms a current mirror with the pass device; and the method further comprises supplying a first voltage depending on the first control voltage to a gate terminal of the second transistor.

7. The method of claim 5, wherein the tracking circuit comprises a third transistor and a current source coupled in series between a drain terminal of the pass device and a predetermined voltage level; and wherein a gate terminal and a drain terminal of the third transistor are coupled to each other, and the second control voltage is the voltage at the gate terminal of the third transistor.

8. The method of claim 5, wherein the fourth transistor is coupled between a source terminal of the first transistor and the output voltage level; and gate and drain terminals of the first transistor are coupled to each other.

* * * * *